US006261106B1

(12) United States Patent
Tung

(10) Patent No.: US 6,261,106 B1
(45) Date of Patent: Jul. 17, 2001

(54) IC CARD CONNECTOR APPARATUS

(75) Inventor: Shun-Chi Tung, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/300,651

(22) Filed: Apr. 27, 1999

(30) Foreign Application Priority Data

Dec. 28, 1998 (TW) ..... 87221650

(51) Int. Cl.[7] ..... H01R 12/00
(52) U.S. Cl. ..... 439/79; 439/541.5
(58) Field of Search ..... 439/64, 79, 80, 439/541.5, 660

(56) References Cited

U.S. PATENT DOCUMENTS 4,715,820 * 12/1987 Andrews, Jr. et al. ..... 439/59
5,364,275 * 11/1994 Ota et al. ..... 439/65
5,601,438 * 2/1997 Ho et al. ..... 439/64
5,636,999 * 6/1997 Hirai et al. ..... 439/79
5,688,130 * 11/1997 Huang ..... 439/79
5,716,221 * 2/1998 Kantner ..... 439/64
5,795,184 * 8/1998 Pan et al. ..... 439/541.5
5,921,787 * 7/1999 Pope et al. ..... 439/74
6,116,919 * 9/2000 Tung ..... 439/79
6,116,920 * 9/2000 Yu et al. ..... 439/79
6,116,925 * 9/2000 Tung ..... 439/101

* cited by examiner

*Primary Examiner*—Tulsidas Patel
(74) *Attorney, Agent, or Firm*—Wei Te Chung

(57) ABSTRACT

An IC card connector apparatus comprises a main body and a socket mounted on a motherboard. The main body includes two stacked housings and a locator proximate the housings. A number of terminals in two sets are disposed in the two housings and arranged in two arrays in the locator. The socket includes an insulative housing which forms a number of passageways and receives a corresponding number of contacts therein. In assembly, the locator is inserted into the socket.

13 Claims, 3 Drawing Sheets

IC CARD CONNECTOR APPARATUS

BACKGROUND OF THE INVENTION

The present invention generally relates to an IC card connector apparatus, and particularly to an IC card connector apparatus which promotes an efficient use of space within a PC enclosure and which effectively eliminates cross talk between terminals thereof.

An IC card connector is commonly disposed in a notebook computer for connecting an IC card to a motherboard. Thus, a large amount of data is exchanged between the IC card and an electrical device mounted on the motherboard. Since the IC card can be movably received or ejected from the IC card connector, such a connector eases a restriction on dimensions of devices within a PC enclosure due to a limited space therein. The related prior art is disclosed in Taiwan Patent Application Nos. 83218076 and 84112508.

FIG. 1 shows a conventional stacked IC card connector 10 and two circuit board connectors 14 mounted on a motherboard 12. Two transition boards 16 are received in the circuit board connectors 14. Four arrays of terminals 18 extending from the stacked IC card connectors 10 are soldered to the two transition boards 16. The stacked IC card connector 10 is electrically connected to the motherboard 12 via the two circuit board connectors 14. However, the terminals 18, boards 16 and circuit board connectors 14 occupy a significant amount of space, which may interfere with an efficient layout of components within the PC enclosure.

The connection of the transition boards 16 to the circuit board connectors 14 requires a high insertion force adversely affecting mechanical stability of the IC card connector 10. In addition, the stacked structure is subject to a higher level of interference whereby false signals may be generated in signal transmission paths.

SUMMARY OF THE INVENTION

Accordingly, a primary purpose of the present invention is to provide an IC card connector apparatus which promotes an efficient use of space within a PC enclosure.

A second purpose of the invention is to provide an IC card connector apparatus benefiting low insertion force.

A third purpose of the invention is to provide an IC card connector apparatus which effectively eliminates cross talk between terminals thereof.

To fulfill the above-mentioned purposes, an IC card connector apparatus comprises a main body and a socket mounted on a motherboard. The main body includes two stacked insulative housings and a locator proximate the housings. Each housing has a mating face and defines a space for receiving an IC card therein. Two arrays of terminals in one set are disposed in each housing. Each terminal forms a mating portion which extends beyond the mating face and into the space for engaging the IC card. The four arrays of terminals are arranged in two arrays in the locator. Each terminal forms a mounting portion opposite and perpendicular to the mating portion. The mounting portions of the terminals are secured in outer opposite sides of the locator.

Moreover, two grounding plates are mounted on the housings and extend substantially parallel to the terminals. One of the grounding plates is bent to abut against the other grounding plate which is received between the two arrays of the mounting portions of the terminals in the locator. In assembly, the locator of the main body is inserted into the socket. The terminals and grounding plate of the main body electrically contact corresponding signal contacts and a grounding shell of the socket, respectively.

DETAILED DESCRIPTION OF THE PREFERRED EMBODIMENT

Figure 1:
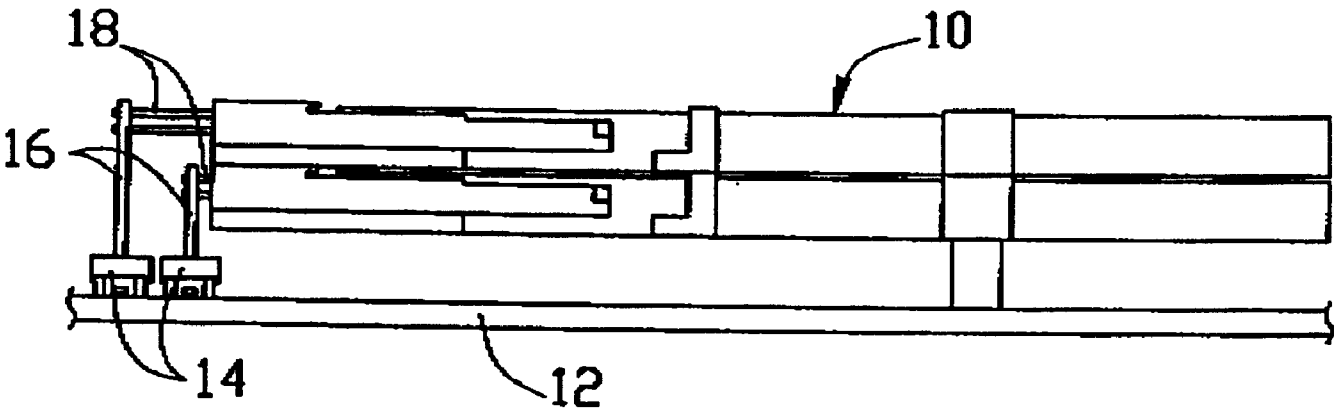
FIG. 1 (PRIOR ART)
FIG. 1 is side planar view of a conventional stacked IC card connector and two card edge connectors mounted on a motherboard.
Figure 2:
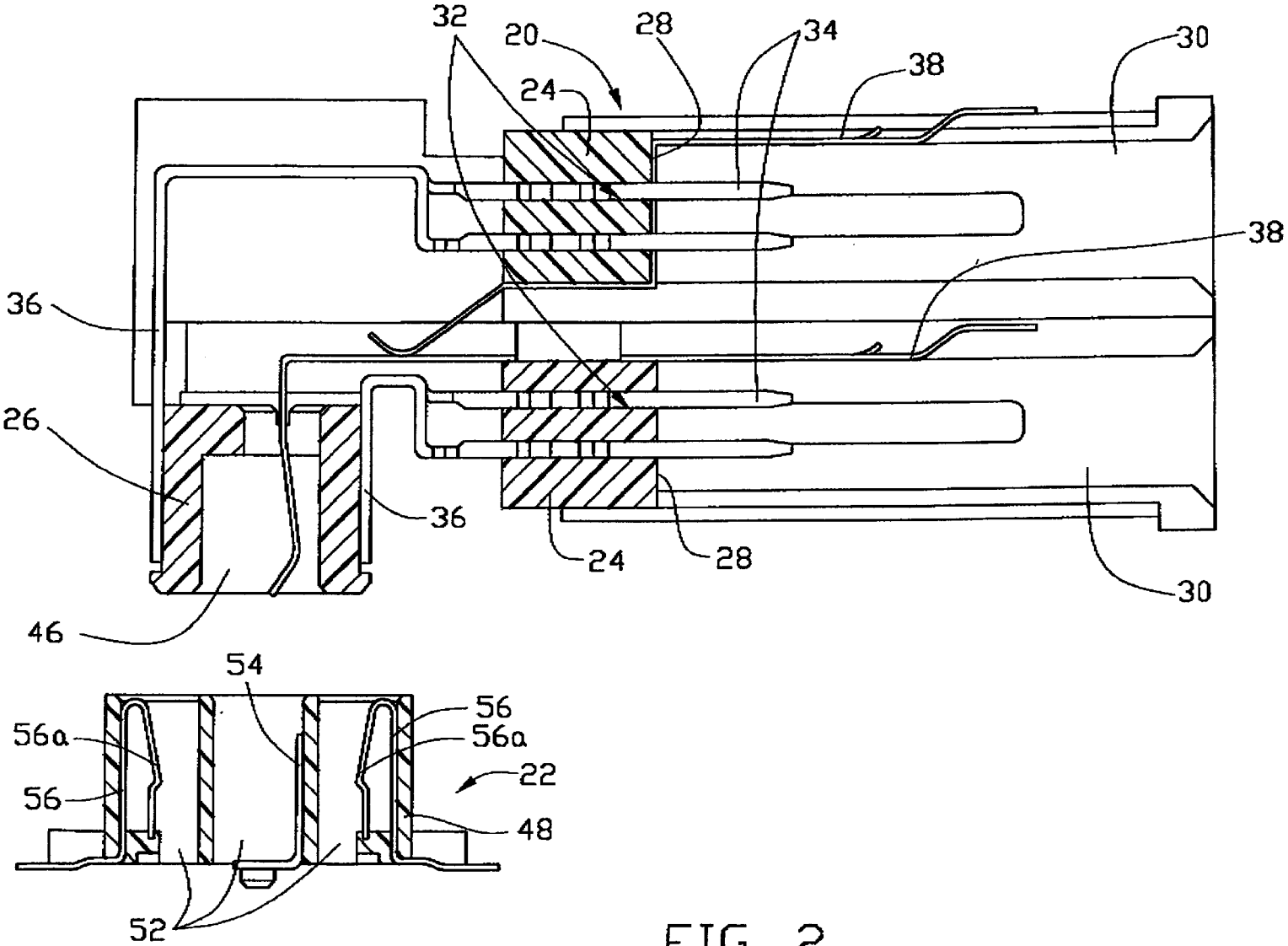
FIG. 2 is an exploded cross-sectional view of an IC card connector apparatus in accordance with the present invention.

Referring to FIG. 2, an IC card connector apparatus comprises a main body 20 and a socket 22 mounted on a motherboard (not shown). The main body 20 includes two stacked insulative housings 24 and a locator 26 proximate the housings 24. Each housing 24 has a mating face 28 and defines a space 30 for receiving an IC card (not shown) therein. The locator 26 forms a cavity 46 in a center portion thereof. Two arrays of terminals 32 in one set are disposed in each housing 24. Each terminal 32 forms a mating portion 34 which extends beyond the mating face 28 into the space 30 for engaging the IC card. The terminals 32 are arranged in two arrays in the locator 26. It follows that the pitch of the arranged terminals 32 along a respective plane in the locator 26 is substantially equal to the half of the mating portions 34 of the terminals 32. Each terminal 32 forms a mounting portion 36 opposite and perpendicular to the mating portion 34. The mounting portions 36 are secured in outer opposite sides of the locator 26.

Moreover, two grounding plates 38 are respectively mounted on upper sides of the two housings 24. One of the two grounding plates 38 is bent to abut against the other grounding plate 38 which extends substantially parallel to the terminals 32 and is received in the cavity 46 of the locator 26.

The socket 22 on the motherboard includes an insulative housing 48 defining three rows of passageways 52. Two arrays of signal contacts 56 are received in the outer passageways 52 while a grounding shell 54 is received in the middle passageway 52. The signal contacts 56 and the grounding shell 54 are all soldered to the motherboard by surface mount technology. In addition, each signal contact 56 forms a reversely bent end 56*a*.

Figure 3:
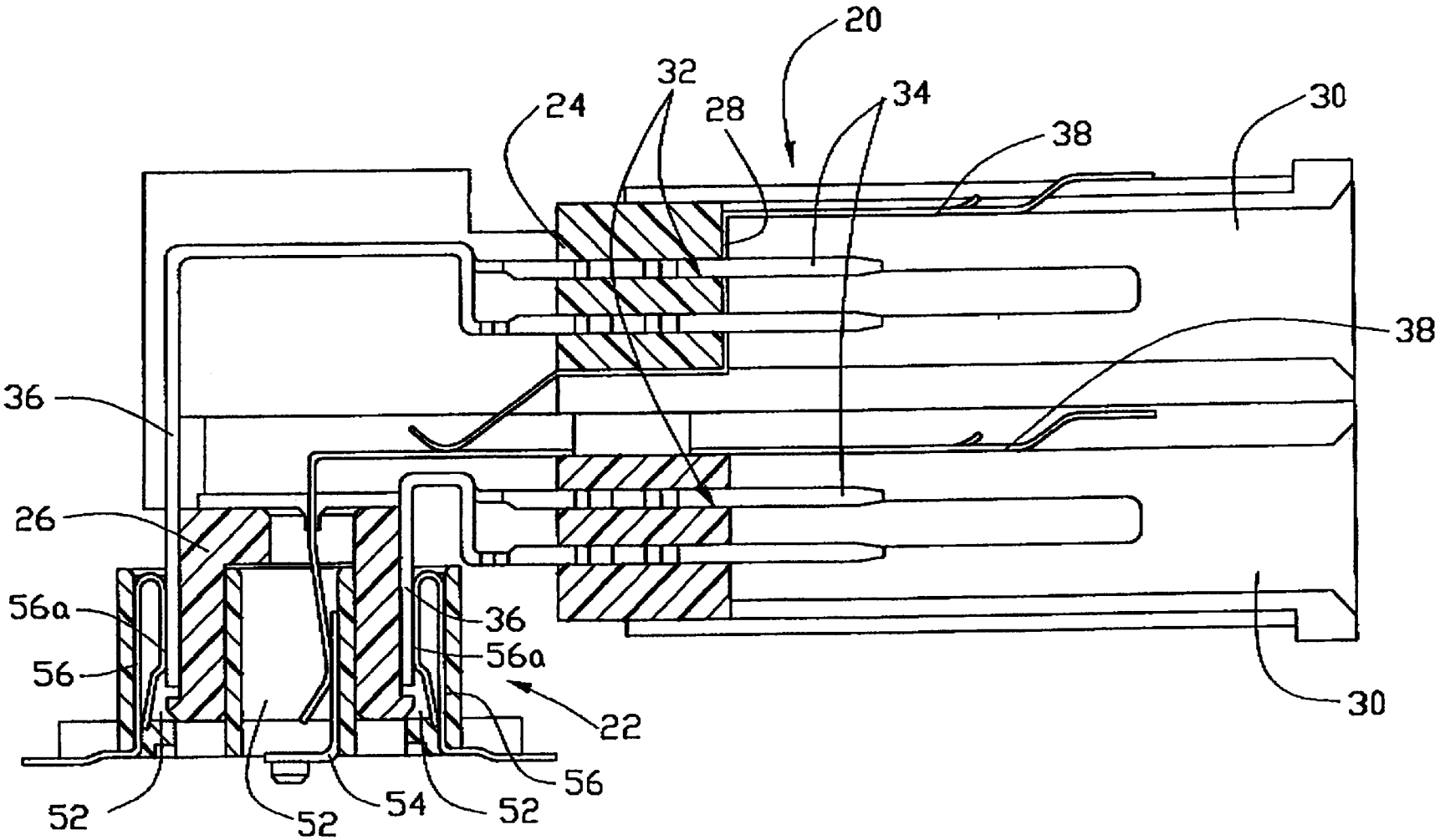
FIG. 3 is an assembled view of FIG. 2.

Referring to FIG. 3, in assembly, the locator 26 of the main body 20 is inserted into the socket 22. The terminals 32 and the grounding plate 38 of the main body 20 engage the signal contacts 56 and the grounding shell 54 of the socket 22, respectively.

It should be noted that the terminals 32 are arranged in two arrays so as to promote an efficient use of space within the PC enclosure. The grounding plate 38 is disposed to spatially separate the two arrays of the terminals 32 in the locator 26 thereby eliminating cross talk therebetween. The reversely bent ends 56*a* provide the signal contacts 56 with resiliency so that the main body contacts the socket with a low insertion force.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An IC card connector apparatus mounted on a motherboard, comprising:

a main body including two stacked housings, a locator proximate the housings, and a plurality of terminals disposed in the housings and arranged in two rows in the locator;

a socket mounted on the motherboard including an insulative housing, the insulative housing defining a plurality of passageways and receiving a corresponding number of contacts therein; and a grounding plate being mounted on an upper side of each housing, one of the grounding plates being bent to abut against the other grounding plate which extends substantially parallel to the terminals and is received in the locator;

wherein the locator is inserted into the socket and the terminals of the main body engage corresponding contacts of the socket.

2. The IC card connector apparatus as claimed in claim 1, wherein the two rows of terminals are retained in outer opposite sides of the locator.

3. The IC card connector apparatus as claimed in claim 1, wherein the socket receives a grounding shell for contacting the grounding plate in the locator.

4. The IC card connector apparatus as claimed in claim 1, wherein each contact of the socket forms a reversely bent end.

5. An IC card connector apparatus comprising:

a main body including two stacked housings and a locator proximate the housing;

a respective row of terminals disposed in each housing and projecting into one of two sides of the locator;

a grounding plate positioned on one of the two housings and extending into the locator to be located between the two rows of terminals; and a socket positioned below the locator and including two passageways with two sets of contacts therein for engagement with corresponding terminals, respectively, and a third passageway with a grounding shell for engagement with the grounding plate;

wherein the two sets of contacts are oppositely spaced from each other by the grounding shell.

6. The connector apparatus as claimed in claim 5, wherein the main body includes two stacked housings each with a row of terminals projecting into two sides of the locator thereby sandwiching the grounding plate therebetween.

7. The connect or apparatus as claimed in claim 6, wherein said locator includes a third sections providing a second set of contacts oppositely spaced from the first set of contacts by the grounding shell.

8. The connector apparatus as claimed in claim 5, wherein said locator defines a cavity, and the grounding plate is received therein.

9. The connector apparatus as claimed in claim 7, wherein said socket defines three rows of passageways for respectively receiving two rows of said terminals and the grounding shell therebetween, respectively.

10. The connector apparatus as claimed in claim 5, wherein two grounding plates respectively positioned on the two housings, and said two grounding plates are mechanically and electrically engaged with each other and only one of said grounding plates extends into the locator.

11. A mating system for use with an IC card connector apparatus, comprising:

a socket defining three passageways generally separated from one another;

two rows of contacts positioned in two outer passageways and a grounding shell positioned in a middle passageway;

a locator located between the IC card connector apparatus and the socket, and defining a center cavity therein; and two rows of terminals of the IC card connector positioned by two outer sides of the locator and a grounding plate is positioned within the center cavity; whereby when the socket and the locator are mated with each other, said two rows of terminals of the locator can be engaged with the corresponding two rows of contacts of the socket, respectively, and the grounding plate may extend into the middle passageway for engagement with the grounding shell.

12. An IC card connector apparatus comprising:

a main body including two stacked housings and a locator proximate the housings, each housing having a row of terminals projecting into one of two sides of the locator;

two grounding plates each positioned on one of the two housings and extending into the locator, a portion of one of the two grounding plates being located between the two rows of terminals; and a socket positioned below the locator and including three rows of passageways for engagement with the two rows of terminals and a grounding shell;

wherein the two grounding plates are mechanically and electrically engaged with each other and only one of the two grounding plates extends into the locator.

13. The connector apparatus as claimed in claim 12, wherein said locator defines a cavity, and the grounding plate is received in the cavity.

* * * * *